United States Patent [19]

Porteous et al.

[11] 4,172,025

[45] Oct. 23, 1979

[54] PROCESS FOR SECONDARY RECOVERY OF BITUMEN IN HOT WATER EXTRACTION OF TAR SAND

[75] Inventors: Kenneth Porteous; William Lavender, both of Edmonton, Canada

[73] Assignees: Petro-Canada Exploration Inc., Calgary; Her Majesty the Queen in right of the Province of Alberta, Government of the Province of Alberta, Department of Energy and Natural Resources, Alberta Syncrude Equity, Edmonton; Ontario Energy Corporation; Imperial Oil Limited, both of Toronto; Canada-Cities Service, Ltd., Calgary; Gulf Oil Canada Limited, Toronto, all of Canada

[21] Appl. No.: 904,770

[22] Filed: May 11, 1978

[51] Int. Cl.[2] ..... C10G 1/04

[52] U.S. Cl. ..... 208/11 LE; 196/14.52

[58] Field of Search ..... 208/11 LE; 196/14.52

[56] References Cited

U.S. PATENT DOCUMENTS

| | | | |
|---|---|---|---|
| 2,453,060 | 11/1948 | Bauer et al. | 208/11 LE |
| 3,935,076 | 1/1976 | Cymbalisty | 208/11 LE |
| 4,105,537 | 8/1978 | McQuitty | 208/11 LE |
| 4,116,809 | 9/1978 | Kizior | 208/11 LE |

*Primary Examiner*—Herbert Levine

*Attorney, Agent, or Firm*—Ernest Peter Johnson

[57] ABSTRACT

It has been found that tank-type air flotation cells are more efficient, when treating hot water process middlings containing in excess of about 3% bitumen, than trough-type air flotation cells. Also, it has been found that the trough-type cells are more efficient than the tank-type cells when treating middlings containing less than about 3% bitumen. Thus a secondary recovery circuit is proposed wherein the middlings are first treated in one or more tank-type cells in series and the underflow from the last tank-type cell is treated in one or more banks of trough-type cells.

3 Claims, 3 Drawing Figures

PROCESS FOR SECONDARY RECOVERY OF BITUMEN IN HOT WATER EXTRACTION OF TAR SAND

BACKGROUND OF THE INVENTION

The invention relates to the recovery of bitumen from tar sands by the process generally known as the hot water process. More particularly, the invention has to do with recovery of a second yield of bitumen in said hot water process. Specifically, the invention describes a new arrangement of air flotation cells which may improve efficiency in recovery at reduced capital cost.

As supplies of conventional crude oil are being used up, the oil industry has been obliged to turn to new sources of hydrocarbons. One such source, that until recently for technological and economic reasons had been ruled out as a hydrocarbon source, has now become commercially viable. The hydrocarbon source referred to is the bitumen contained in tar sands. Substantial deposits of tar sands are found in a variety of locations throughout the world, but the largest and most amenable to current treatment is the Athabasca deposit located in the north eastern region of the Province of Alberta, Canada. It has been estimated that the deposit contains up to 600 billion barrels of crude oil equivalent.

The system presently used commercially for recovering the bitumen from tar sand involves mining the deposit and transferring the mined tar sand to a bitumen recovery plant wherein the hydrocarbons are extracted by the hot water process. The advantage of proceeding by this route is the very high level of recovery that is attainable. At the commercial level, 93% of the bitumen may commonly be extracted.

The tar sand varies in composition throughout the deposit and therefore it is something of a problem to give a typical characterization. However, the sand particles of the deposit are of such a size as to be retained by a screen of 325 mesh—yet clays and silts having a much smaller particle size (−325 mesh size) are also present and vary in quantity from 0% to 50% of the mineral solids. The quantity of bitumen as a proportion of the total composition is typically of the order of 12% by weight, however it can vary between 6 and 18%. The mineral solid content of tar sand may range up to 85% by weight or thereabouts. Water connate to the deposit is also present, and this in turn may have dissolved therein various water soluble salts.

Fine mineral material is known to be deleterious to the hot water extraction process. And since these undesirable particles are present in many types of tar sand feed, the hot water process has had to be designed to accommodate them. Also, certain dissolved salts, especially those with chloride anion and with bivalent cation, are believed to be disadvantageous. Of particular importance in the design of a hot water extraction circuit, to compensate for variations in tar sand feed, is the secondary flotation circuit wherein a second yield of froth is obtained. The significance of this secondary circuit, together with its bearing on the present invention will be made clear hereinafter.

According to the hot water process as commonly practised, mined tar sand is added to a rotating mixing/-slurrying drum horizontally mounted and capable of rotation about its longitudinal axis. Such drum is hereinafter referred to as the tumbler. As well as the tar sand, hot water, steam, and for most tar sand feeds, a relatively minor amount of a process aid is also added to the tumbler. The temperature is given final adjustment to raise the tumbler product to about 180° F. by the addition of steam introduced via sparging valves set in pipes passing along the length of the inside of the tumbler. The process aid commonly added assists in the conditioning reaction and is used for all tar sand types except the very rich material, that is for all tar sand having a bitumen content of less than around 12% bitumen. The most favored process aid is sodium hydroxide; it is added in such quantities as to raise the pH of the aqueous phase of the mixture to about 9.0. Feed materials are fed to the tumbler in the following typical proportions by weight: tar sand, 100; water, 19; sodium hydroxide solution (at specific gravity of 1.22) 0.025. However, as will be clear from the foregoing discussion, these quantities may have to be varied widely to achieve optimum bitumen recovery.

It is usual for the rate of feed to be set such that it takes less than 10 minutes for tar sand to pass through the tumbler from the inlet to the outlet end. During this time the bitumen is dislodged from the sand particles so that what enters as tar sand, with bitumen and said tightly bound together (with interstitial water connate to the deposit probably also involved in such bonding), leaves as a mixture, with bitumen, sand, and water merely in loose association, and in such a state that, should suitable conditions be provided, the sand and the bitumen will separate severally from the mixture. Such suitable conditions are provided in the next stage, primary separation, but first the slurry emerging from the tumbler is screened, to remove oversized debris such as rocks and lumps of undigested tar sand, and is then diluted with further hot water (50 weight parts per 100 parts tar sand).

The primary separation vessel is a bath filled, at the beginning of a run, with hot water. The contents of the bath are maintained in a quiescent condition. The screened, diluted slurry is discharged into the central region of the substantially aqueous contents of the primary separation vessel with the following effects:

- Most of the sand, especially the coarse sand, sinks to the bottom and may be pumped out as an aqueous tailings stream;
- Bitumen particles having a sufficient rise velocity rise to the surface of the vessel and are collected as a froth (primary froth). The relative buoyancy of individual particles depends on the size of the particle and the volume of air attached to it;
- Bitumen particles having low rise velocities by virtue of their size or lack of aeration, along with much of the fine mineral matter, collectively having a density close to that of the aqueous contents of the vessel, remain in the central region of the vessel.

The last mentioned mixture of unrecovered bitumen, water, and fine solids (collectively known as "middlings") contains valuable amounts of bitumen that it is advantageous to recover. Hence middlings are continuously withdrawn to obtain a further yield of bitumen therefrom. The middlings portion thus withdrawn is advanced to a circuit of flotation cells where it is vigorously agitated with air to produce a second froth (secondary froth) and a further tailings stream (secondary tailings).

It is advantageous to operate the process in such a way as to cause as much of the bitumen as possible to report to the primary froth because this reduces the loss of bitumen with primary tailings and the purity of said primary froth is high. Typically, primary froth contains 66.40% by weight of bitumen while secondary froth typically has only 23.78% bitumen and also contains such large quantities of entrained water and fine minerals that it must be cleaned in a froth settler wherein some water and solids separate out. After the cleaning step, the secondary froth is combined with the primary froth and the combined froth advanced to a dilution centrifuging circuit to isolate the bitumen in a substantially pure form.

In the dilution centrifuging circuit, the froth is diluted with a naphtha or other organic diluent to decrease the density of the hydrocarbon phase, and then centrifuging is applied in two stages. Larger sized mineral particles and some of the water are removed in a first stage degritting centrifuge and remaining water and fine minerals are removed by a high-speed disc-nozzle centrifuge. The naphtha or other diluent may then be conveniently removed from the centrifugate by distillation.

Further treatment of the isolated bitumen is necessary to "crack" the molecules to species of lower molecular weight. This is commonly done by delayed or fluid coking. The resulting hydrocarbon mixture is a synthetic crude oil suitable for refining.

The secondary circuit, in which a second yield of bitumen is recovered from middlings withdrawn from the mid portion of the primary separation vessel, effectively serves two purposes. First, it is the means by which, in the normal operation of the hot water process, the efficiency of the overall process may be enhanced by collecting that bitumen which fails to report to the primary froth. In said normal operation, the concentration of bitumen in the total middlings is somewhat less than 3% by weight and represents less than 10% of the bitumen initially present in the tar sand. Secondly, and more importantly, the secondary circuit serves as a safety back-up for those occasions when, for whatever reasons, the recovery of bitumen in the primary separation cell is reduced, thus leaving considerable quantities of bitumen in the middlings phase. Under these circumstances the proportion of bitumen in the middlings fed to the secondary circuit can be so high as to represent 50% of the bitumen initially present in the tar sand feed. Given the variability of the tar sand feed, especially with respect to such factors as mineral particles of small particle size already referred to, this function of the secondary circuit may be called upon quite frequently. Since an excess of air is positively blown into the middlings pulp in the secondary circuit, substantially all bitumen entering said secondary circuit is recoverable under the vigorous aeration conditions applied therein and the secondary circuit is therefore a valuable element in the overall efficiency of the process.

Two types of air flotation units are known to the industry, namely the trough-type and the tank-type. Only the trough-type has hitherto been employed in commercially-operated secondary cells in hot water extraction of bitumen, such cells often being constructed in banks usually of three or more individual flotation stages or cells wherein underflow from the first cell becomes feed for the next. In some designs a single trough may have several zones of aeration and agitator action, i.e., flotation stages, without discrete and separate individual cells. Both are conveniently referred to as banks of cells.

SUMMARY OF THE INVENTION

We have discovered that, when the bitumen content of the stream fed to a secondary circuit is less than about 3% by weight, the trough-type cell flotation stage is as efficient if not more efficient than the tank-type cell; however, when the bitumen content exceeds about 3%, the tank-type cell is significantly more efficient.

In accordance with the present invention, the middlings are treated by air flotation, firstly in one or more tank-type flotation cells in series and then the underflow from the last of these cells is fed through one or more banks of trough-type flotation cells. It is intended that the term "bank" includes one or more cells and that, in the case where the bank has a plurality of cells, the downstream cell is fed the underflow from the upstream cell. In a preferred feature the circuit is designed so that the tank-type cell capacity is sufficient to process the maximum expected high-bitumen middlings and reduce the bitumen content of the underflow to something less than about 3% by weight (expressed as a proportion of the emerging stream).

Broadly stated, one version of the invention is an improvement on the hot water extraction process for recovering bitumen from tar sand, wherein tar sand is conditioned in a tumbler, flooded with additional water, and subjected to flotation in a primary separation vessel to produce primary froth, middlings and tailings streams. The improvement comprises recovering bitumen from the middlings stream by first subjecting the stream to air flotation in one or more tank-type flotation cells in series and then subjecting the underflow from the last tank-type cell to air flotation in one or more banks of trough-type flotation cells.

Another version of the invention is a circuit for recovering bitumen from hot water process middlings discharged from a primary separation vessel comprising, in combination and in sequence, one or more tank-type flotation cells in series operative to treat the middlings by air flotation; and one or more trough-type flotation cell banks operative to treat the underflow from the last tank-type cell by air flotation.

One advantage of the invention is that, during normal operation of the hot water process, the middlings stream may be effectively processed with a lower investment in the processing plant.

A second advantage is that, during upsets or with abnormal tar sand quality in the hot water extraction process when the bitumen load advanced to the secondary circuit is higher than normal, the arrangement of flotation cells described in the invention effectively deals with such problems, the tank-type flotation cell being better suited to middlings whose bitumen content is higher than about 3%.

DESCRIPTION OF THE PREFERRED EMBODIMENT

Figure 1:
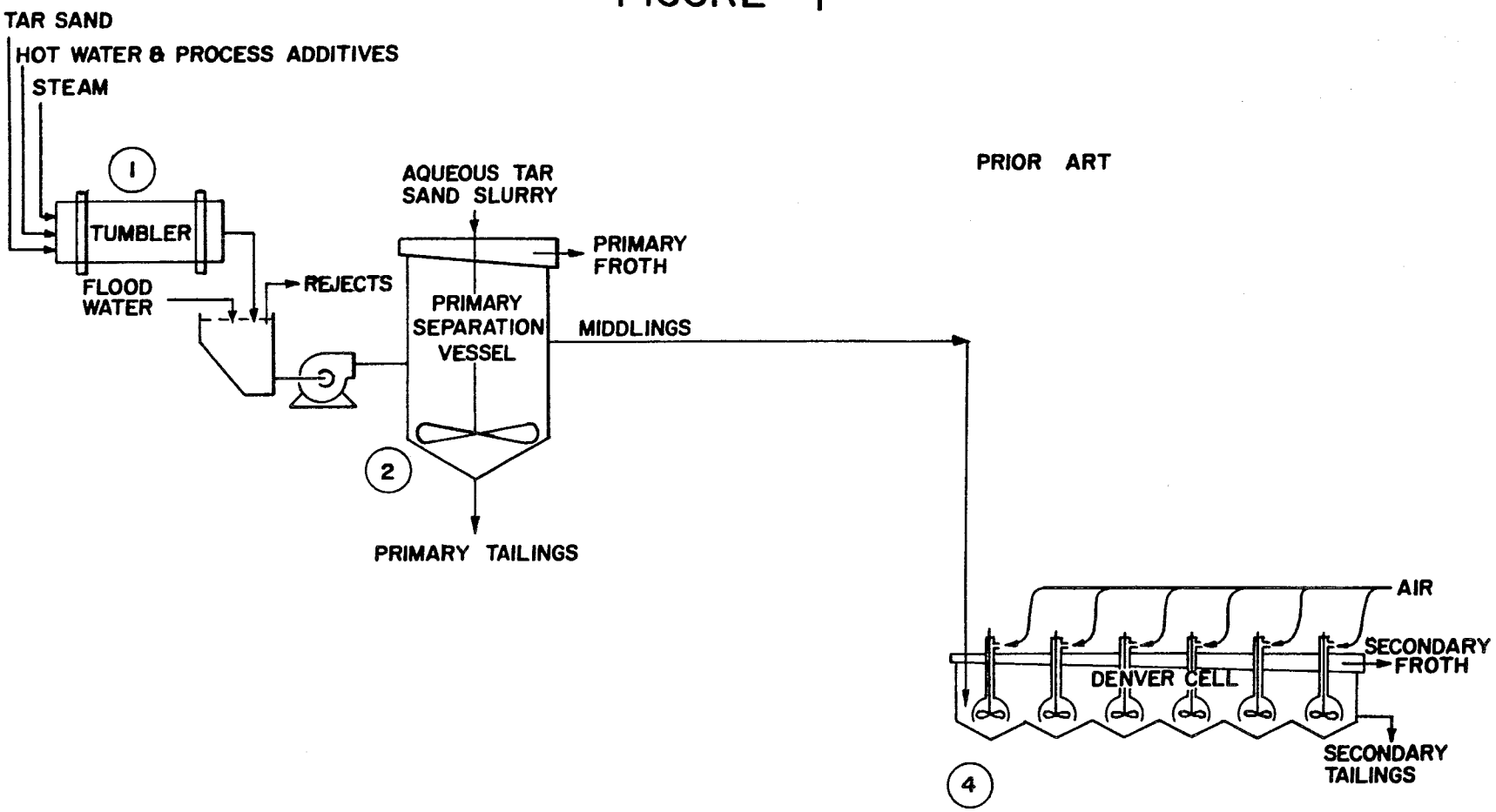
FIGURE 1 PRIOR ART
FIG. 1 is a schematic drawing showing the prior art system comprising tumbler, primary separation vessel, and secondary recovery circuit.
Figure 2:
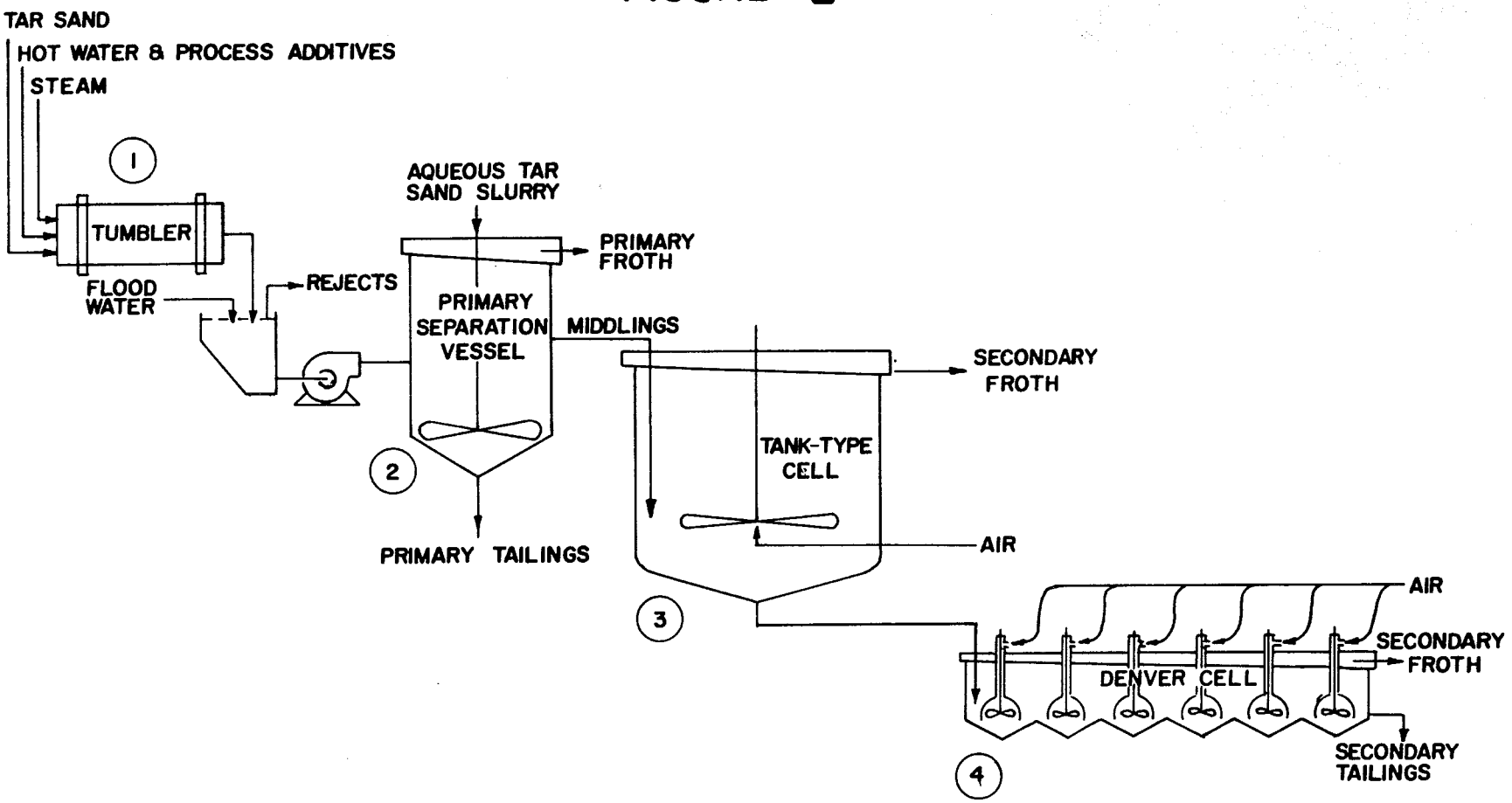
FIG. 2 is a schematic drawing showing a system in accordance with the invention.

The invention is illustrated by the following example based on pilot plant runs carried out using the equipment shown in FIG. 2.

Tar sand was fed to a pilot plant tumbler 1 at a rate of 15 tons per hour. Hot water at 190° F., caustic soda and steam were added to the tumbler and slurried with the tar sand. Water addition was sufficient to produce a slurry containing about 22 weight % water. Steam was controlled to give a slurry temperature of 180° F. and caustic added to give an ultimate middlings aqueous phase pH of about 9.0. This slurry was screened to remove rocks, debris, and undigested tar sand. Reject amounted to about 2.89% of the tar sand feed and represented a loss of about 0.5% of the feed bitumen. Flood water at 190° F. was used to dilute the slurry prior to feeding it to the primary separation vessel 2. Solids levels in the flooded slurry were 40 to 50% by weight depending on the type of tar sand feed. Primary froth middlings and tailings streams were produced in the primary separation step. The total middlings produced in this manner were subsequently treated in air flotation cells. Typically, 25 gpm of middlings were produced.

During the pilot plant program, two types of cell were evaluated on both regular and high fines tar sand middlings. The tank-type flotation cell used was a Maxwell* cell while the trough-type flotation cell was a Denver Sub A* cell.

*trade mark

The tank-type cell 3 had a nominal volume of 12 cubic feet and a diameter of 2.5 feet. It was equipped with a bent paddle impeller and was operated at an air injection rate of 4.5 scfm with an impeller speed of 730 rpm.

The trough-type cell bank 4 consisted of six 12 cubic foot cells in series. Air induction into the cells was controlled manually to maximize cell froth production.

Comparison of the performance of the tank-type and a single trough-type cell flotation stage is complicated by variations in feed composition and flow rate. In this regard, it should be pointed out that test work is made difficult by the uncontrolled nature of the middlings stream, i.e., it represents what is left over from the primary separation after removal of froth and tailings. The appropriate performance criterion is the rate of bitumen recovery per unit of volume of cell. Table I shows experimentally—determined recovery functions for the two cell types as a function of the bitumen content in the cell feed.

TABLE I

| Cell Type | Cell Feed Bitumen Content wt. % | REcovery Function lb. bitumen/hr-ft$^3$ cell |
|---|---|---|
| Trough-type | 8.12 | 29.22 |
| Tank-type | 9.33 | 57.26 |
| Trough-type | 4.77 | 16.06 |
| Tank-type | 4.45 | 16.66 |
| Trough-type | 2.59 | 6.68 |
| Tank-type | 2.01 | 3.22 |
| Trough-type | 1.79 | 4.57 |
| Tank-type | 1.79 | 3.47 |

These data demonstrate tht the tank-type flotation cell recovers significantly more bitumen per unit volume than the trough-type flotation cell when the cell feed bitumen level is high. For cell feed bitumen levels of about 3%–4% by weight the quantities of bitumen recovered in both cells are about the same. Below 3% the trough-type flotation cell has a slight advantage.

Figure 3:
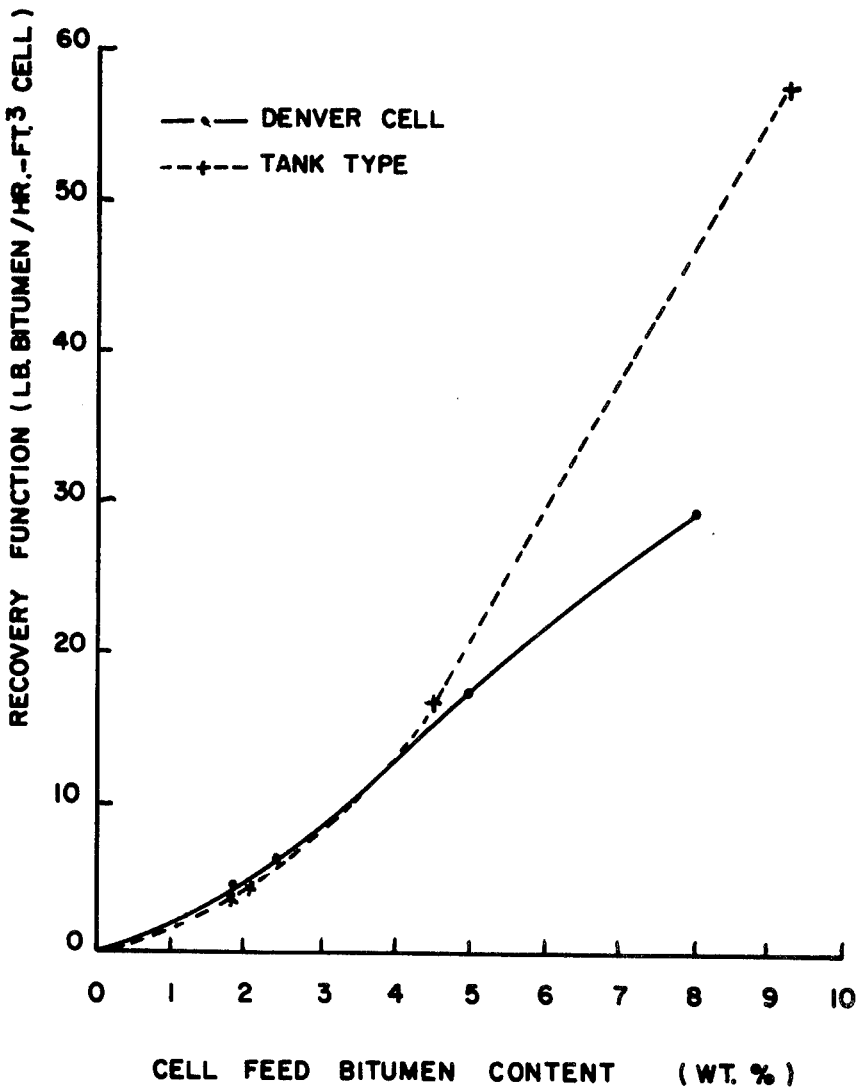
FIG. 3 is a plot showing comparative recovery performance for tank-type and trough-type flotation cells.

This invention therefore is based on the concept of using a combination of tank-type and trough-type flotation cells to practise bitumen recovery on middlings. The tank-type cell(s) is the first to treat the middlings and the trough-type cell(s) treat the underflow from the former. The improvement which is obtained is clearly set forth in FIG. 3.

The embodiments of the invention in which an exclusive property or privilege is claimed are defined as follows:

1. In the hot water extraction process for recovering bitumen from tar sand, wherein tar sand is conditioned in a tumbler, flooded with additional water, and subjected to flotation in a primary separation vessel to produce primary froth, middlings and tailings streams, the improvement comprising:

recovering bitumen from the middlings stream by first subjecting the stream to air flotation in one or more tank-type flotation cells in series and then subjecting the underflow from the last tank-type cell to air flotation in one or more banks of trough-type flotation cells.

2. The improvement as set forth in claim 1 wherein:

air flotation in the tank-type cell is continued until the underflow forwarded to the bank of trough-type cells contains less than about 3% bitumen by weight.

3. A circuit for recovering bitumen from hot water process middlings discharged from a primary separation vessel comprising, in combination and in sequence, one or more tank-type flotation cells in series operative to treat the middlings by air flotation; and one or more trough-type flotation cell banks operative to treat the underflow from the last tank-type cell by air flotation.

* * * * *